US008834601B2

(12) United States Patent
Haidar

(10) Patent No.: US 8,834,601 B2
(45) Date of Patent: Sep. 16, 2014

(54) METHOD FOR PRODUCING LOW ALUMINIUM TITANIUM-ALUMINIUM ALLOYS

(75) Inventor: Jawad Haidar, Lindfield (AU)

(73) Assignee: Commonwealth Scientific and Industrial Research Organisation, Austrailian Capital Territory (AU)

( * ) Notice: Subject to any disclaimer, the term of this patent is extended or adjusted under 35 U.S.C. 154(b) by 198 days.

(21) Appl. No.: 13/514,990

(22) PCT Filed: Dec. 17, 2010

(86) PCT No.: PCT/AU2010/001697

§ 371 (c)(1),
(2), (4) Date: Aug. 15, 2012

(87) PCT Pub. No.: WO2011/072338

PCT Pub. Date: Jun. 23, 2011

(65) Prior Publication Data

US 2013/0019717 A1 Jan. 24, 2013

(30) Foreign Application Priority Data

Dec. 18, 2009 (AU) ..... 2009906168

(51) Int. Cl.

| | |
|---|---|
| ***C22C 14/00*** | (2006.01) |
| ***C22B 5/00*** | (2006.01) |
| ***C22B 34/00*** | (2006.01) |
| ***C22B 34/12*** | (2006.01) |
| ***C22B 5/04*** | (2006.01) |

(52) U.S. Cl.

CPC ..... *C22C 14/00* (2013.01); *C22B 34/1277* (2013.01); *C22B 5/04* (2013.01)

USPC ..... 75/615; 75/616; 75/617; 75/620; 420/418

(58) Field of Classification Search

CPC ..... C22B 5/04; C22B 34/1227; C22C 14/00
USPC ..... 75/615–617, 620; 420/590
See application file for complete search history.

(56) References Cited

U.S. PATENT DOCUMENTS

| | | | |
|---|---|---|---|
| 2,745,735 | A | 5/1956 | Byrns |
| 3,004,848 | A | 1/1961 | Hansley et al. |

(Continued)

FOREIGN PATENT DOCUMENTS

| | | |
|---|---|---|
| DE | 2747016 | 4/1978 |
| EP | 0097135 | 12/1983 |

(Continued)

OTHER PUBLICATIONS

May 21, 2007, ISR for PCT/AU2007/000385.

(Continued)

*Primary Examiner* — George Wyszomierski
*Assistant Examiner* — Tima M McGuthry Banks
(74) *Attorney, Agent, or Firm* — Neifeld IP Law

(57) ABSTRACT

A method for producing a titanium-aluminum alloy containing less than about 15 wt. % aluminum, comprising: a first step in which an amount of titanium subchlorides at or in excess of a stoichiometric amount required to produce the titanium-aluminum alloy are reduced by aluminum to form a reaction mixture comprising elemental titanium, and then a second step in which the reaction mixture comprising elemental titanium is heated to form the titanium-aluminum alloy, whereby reaction kinetics of the method are controlled such that reactions resulting in formation of titanium aluminides are minimized.

35 Claims, 1 Drawing Sheet

(56) References Cited

U.S. PATENT DOCUMENTS

| | | | |
|---|---|---|---|
| 3,252,823 | A | 5/1966 | Jacobson et al. |
| 3,301,665 | A | 1/1967 | Timm et al. |
| 3,450,525 | A | 6/1969 | Van Den Steen |
| 3,455,678 | A | 7/1969 | Shapiro et al. |
| 3,684,264 | A | 8/1972 | Petrov et al. |
| 3,900,312 | A | 8/1975 | Terry et al. |
| 4,437,888 | A | 3/1984 | Jecker |
| 4,447,045 | A | 5/1984 | Kimura et al. |
| 4,508,322 | A | 4/1985 | Kimura et al. |
| 4,877,445 | A | 10/1989 | Okudaira et al. |
| 4,902,341 | A | 2/1990 | Okudaira et al. |
| 5,032,176 | A | 7/1991 | Kametani et al. |
| 5,397,375 | A | 3/1995 | O'Donnell et al. |
| 5,460,642 | A | 10/1995 | Leland |
| 5,935,293 | A | 8/1999 | Detering et al. |
| 2002/0184971 | A1 | 12/2002 | Myrick |
| 2004/0050208 | A1 | 3/2004 | Nie et al. |
| 2006/0191372 | A1 | 8/2006 | Haidar |
| 2009/0165597 | A1 | 7/2009 | Haidar et al. |
| 2011/0091350 | A1 | 4/2011 | Haidar |

FOREIGN PATENT DOCUMENTS

| | | |
|---|---|---|
| EP | 0134643 | 6/1984 |
| EP | 0298698 | 1/1989 |
| GB | 754869 | 8/1956 |
| GB | 757873 | 9/1956 |
| GB | 1516257 | 6/1978 |
| GB | 1566363 | 4/1980 |
| GB | 2158102 | 11/1985 |
| JP | 52-32988 | 3/1977 |
| JP | 52-078608 | 7/1977 |
| JP | 64-15334 | 1/1989 |
| JP | 4-107234 | 4/1992 |
| JP | 2001192711 | 7/2001 |
| RU | 2082561 | 6/1997 |
| UA | 38454 | 5/2001 |
| WO | WO92/14851 | 9/1992 |
| WO | WO 2005/002766 | 1/2005 |
| WO | WO2007/109847 | 10/2007 |

OTHER PUBLICATIONS

Feb. 8, 2008, IPER for PCT/AU2007/000385.
Jun. 19, 2009, ISR for PCT/AU2009/000501.
Jun. 23, 2011, ISR for PCT/AU2010/001697.
Supplementary ESR for copending European Application EP 07718632, completed Mar. 25, 2010.
English Translation of Official Decision on Grant in corresponding Ukrainian Application No. 2008 12511, issued May 14, 2010.
Bartlett et al., "Titanium Powder by Magnesium Reduction of TiCl in Liquid Zinc Alloy," Light Metals, 1994, pp. 1181-1186.
Bertolino, et al. "Ignition mechanism in combustion synthesis of T—Al and Ti—Ni systems," Intermetallics 11, 2003, pp. 41-49.
Chen et al. "Direct electrochemical reduction of titanium dioxide to titanium in molten calcium chloride," Nature, vol. 407, Sep. 2000, pp. 361-364.
DeKock et al., "Attempted Preparation of Ti-6-4 Alloy Powders from $TiCl_4$, Al, $VCl_4$ and Na," Metallurgical Transactions B, vol. 18B, Sep. 1987, pp. 511-517.
Gerdemann et al. "Titanium Aluminicide Powder Reduction Via Reaction Between $TiCl_4$ and Al," Gamma Titanium Aluminides, 1999, pp. 341-346.
D. Hu; "Effect of boron addition on tensile ductility in lamellar TiAl alloys", Intermetallics 10 (2002) pp. 851-858.
Lu, et al. "The mechanical Alloying of Titanium Aluminides," JOM, Feb. 2002, pp. 62-64.
Aug. 3, 1994, Murphy et al. "Equilibrium Calculation of the Reduction of Titanium Tetrachloride by Aluminum and Hydrogen" High Temp. Chem. Processes 3, Aug. 1994, pp. 365-374.
Okabe et al., "Reaction Pathways during Metallothermic Reduction of $TiCl_4$ by Utilizing Chemical Potential Diagrams," Titanium Extracting and Processing, 1997, pp. 133-150.
Reddy, et al. "Thermodynamic properties of Ti—Al intermetallics," Journal of Alloys and Compounds 321, 2001, pp. 223-227.
T. Uda et al.; "Contactless Electrochemical Reduction of Titanium (II) Chloride by Aluminum", Metallurgical and Materials Transactions B, vol. 31B, Aug. 2000, pp. 713-721.
U.S. Appl. No. 10/560,804 Jawad Haidar, Dec. 15, 2005, published as US 2006/0191372.
Jul. 29, 2004 ISR PCT/AU2004/000899.
Jun. 23, 2011, International Search Report for PCT/AU2010/001697.

METHOD FOR PRODUCING LOW ALUMINIUM TITANIUM-ALUMINIUM ALLOYS

CROSS REFERENCE TO RELATED APPLICATIONS

This application is a national stage entry of PCT/AU2010/001697, filed Dec. 17, 2010, which claims priority to Application No. AU 2009906168, filed Dec. 18, 2009.

FIELD OF THE INVENTION

The present invention relates to methods for producing titanium-aluminium alloys with a low aluminium content (i.e. containing less than about 15 wt. % aluminium).

BACKGROUND TO THE INVENTION

Titanium-aluminium (Ti—Al) based alloys and alloys based on titanium-aluminium (Ti—Al) inter-metallic compounds are very valuable materials. However, they can be difficult and expensive to prepare, particularly in a powder form. This expense of preparation limits wide use of these materials, even though they have highly desirable properties for use in aerospace, automotive and other industries.

Reactors and methods for forming titanium-aluminium based alloys and inter-metallic compounds have been disclosed. For example, WO 2007/109847 discloses a stepwise method for the production of titanium-aluminium based alloys and inter-metallic compounds. WO 2007/109847 describes the production of titanium-aluminium based alloys and inter-metallic compounds via a two stage reduction process, based on the reduction of titanium tetrachloride with aluminium. In stage 1, $TiCl_4$ is reduced with Al (optionally in the presence of $AlCl_3$) to produce titanium subchlorides according to the following reaction:

$$TiCl_4+(1.333+x)Al \rightarrow TiCl_3+(1+x)Al+0.333AlCl_3$$

$$TiCl_4+(1.333+x)Al \rightarrow TiCl_2+(0.666+x)Al+0.666AlCl_3$$

In stage 2, the products from stage 1 are processed at temperatures between 200° C. and 1300° C. to produce the titanium-aluminium based alloys or inter-metallic compounds in a powder form, according to the following (simplified) reaction scheme:

$$TiCl_3+(1+x)Al \rightarrow Ti—Al_x+AlCl_3$$

$$TiCl_2+(0.666+x)Al \rightarrow Ti—Al_x+0.666AlCl_3$$

Whilst the reactors and methods disclosed in WO 2007/109847 are useful for producing titanium-aluminides such as γ-TiAl and $Ti_3Al$ (which contain a relatively high proportion of aluminium), they have not been able to reliably and consistently produce low-aluminium titanium-aluminium based alloys (i.e. titanium-aluminium based alloys containing less than about 12-15 weight % (12-15 wt. %) aluminium).

WO 2009/129570 discloses a reactor adapted to address one of the problems associated with the reactors and methods disclosed in WO 2007/109847, when such are used under the conditions that would be required to form low-aluminium titanium-aluminium based alloys. In particular, when operating in accordance with the conditions required to form low-aluminium titanium-aluminium based alloys, the reaction materials tend to accrete at a particular temperature, which can clog the reactor and prevent it from continuously operating. The reactor of WO 2009/129570 comprises a removing apparatus, which is operable to remove any accreted materials from an intermediate section of the reactor that is maintained at the temperature at which accretion can occur. The intermediate section may also be adapted such that materials are quickly transferred therethrough in order to minimise the time spent by the material at temperatures at which accretion can occur.

The above references to the background art do not constitute an admission that such art forms a part of the common general knowledge of a person of ordinary skill in the art.

SUMMARY OF THE INVENTION

The inventor has endeavoured to develop new methods for producing low-aluminium titanium-aluminium alloys, and in a more pure form. The conventional belief in the art, based on numerical simulations of equilibrium chemistry as well as physical observations, was that aluminium is not a suitable reductant to produce titanium-aluminium alloys containing less than about 10-15 wt. % aluminium, because titanium chlorides and aluminium would react via a direct reaction to form titanium aluminides (i.e. titanium-aluminium alloys containing a relatively high proportion of aluminium). Once titanium aluminides are formed, the inventor has found that they do not typically react any further, and it is therefore not possible to reduce their aluminium content to obtain a low aluminium alloy. However, the inventor's research has led to the unexpected discovery that titanium aluminides are not formed via the direct reaction mechanism previously thought to occur between titanium chlorides and aluminium, but that they are mostly formed when the elemental titanium and aluminium chlorides produced by the reduction reactions react together.

The inventor has discovered that it is possible to minimise the formation of titanium aluminides by exposing the reactants to conditions of non-equilibrium by strictly controlling the reaction kinetics of the reactions which occur during the formation of the low-aluminium titanium-aluminium alloys.

Accordingly, in a first aspect, the present invention provides a method for producing a titanium-aluminium alloy containing less than about 15 wt. % aluminium. The method comprises a first step in which an amount of titanium subchlorides at or in excess of the stoichiometric amount required to produce the titanium-aluminium alloy are reduced by aluminium to form a reaction mixture comprising elemental titanium, and then a second step in which the reaction mixture comprising elemental titanium is heated to form the titanium-aluminium alloy. The reaction kinetics are controlled such that reactions resulting in the formation of titanium aluminides are minimised.

As discussed above, the inventor has discovered that titanium aluminides are mostly formed when the elemental titanium and aluminium chlorides produced by the reduction reactions react together. Accordingly, the reaction kinetics are typically controlled such that reactions between aluminium chlorides (mostly gaseous aluminium chlorides) formed during the method and the elemental titanium are minimised.

In the method of the present invention, the reaction kinetics are controlled such that reactions resulting in the formation of titanium aluminides (e.g. between gaseous aluminium chlorides formed during the method and the elemental titanium) are minimised. Those skilled in the art will appreciate that the kinetics of a reaction govern when the reaction will proceed, and at what rate. For example, reactions may not occur until the required activation energy is provided. Some reactions may be exothermic and require no further heating once they have commenced, or may even require the temperature conditions to be controlled, lest the reaction produce so much heat as to result in the formation of uncontrollable products. Some reactions may proceed very slowly at a low temperature, but rapidly at slightly higher temperatures or vice versa.

As will be appreciated, there are numerous techniques by which the kinetics of a reaction can be controlled. For example, reaction kinetics may be controlled by controlling the temperature and/or pressure to which the reactants are exposed. The reaction kinetics may be controlled by controlling the length of time to which the reactions are exposed to those conditions. Reaction kinetics can also be controlled by controlling the relative concentrations of the reactants and/or products.

As used herein, the term "titanium-aluminium alloy", or the like, is to be understood to encompass an alloy based on titanium-aluminium or an alloy based on titanium-aluminium intermetallic compounds.

As used herein, the term "low aluminium titanium-aluminium alloy", or the like, is to be understood to mean a titanium-aluminium alloy containing less than about 15 wt. %, e.g. less than about 10-15 wt. % of aluminium. In some embodiments, a low aluminium titanium-aluminium alloy may comprise from about 0.1 to about 7 wt. % Al.

As used herein, the term "aluminium chlorides" is to be understood to refer to gaseous aluminium chloride species formed during the method. These species are typically gaseous at the temperatures used in the method and include $AlCl_3$ or any other gaseous Al—Cl compounds such as AlCl, $Al_2Cl_6$ and $Al_2Cl_4$.

As used herein, the term "titanium subchloride" is to be understood to refer to titanium trichloride $TiCl_3$ and/or titanium dichloride $TiCl_2$, or other, combinations of titanium and chlorine, but not to $TiCl_4$, which is referred to herein as titanium tetrachloride. In some sections of the specification, the more general term "titanium chlorides" may be used, which is to be understood to refer to gaseous forms of titanium tetrachloride ($TiCl_4$), titanium trichloride ($TiCl_3$), titanium dichloride ($TiCl_2$) and/or other combinations of titanium and chlorine.

In some embodiments, the reaction kinetics are controlled by causing the concentration of gaseous aluminium chlorides formed during the method in the atmosphere surrounding the heated reaction mixture to be reduced. For example, the gaseous aluminium chlorides formed during the method may be caused to become entrained in and diluted by a flow of an inert gas (e.g. He or Ar). Alternatively, or in addition, the gaseous aluminium chlorides formed during the method may be diluted by gaseous titanium chlorides also formed at a relatively high temperature during the method. As the concentration of gaseous aluminium chlorides in the atmosphere surrounding the heated reaction mixture is reduced, the likelihood of "back-reactions" between gaseous aluminium chlorides and elemental titanium (or indeed other titanium containing species in the reaction mixture) is minimised, substantially reducing the amount of titanium aluminides that can be formed via this reaction pathway. The inventor has also discovered that reducing the concentration of the gaseous aluminium chlorides in this manner helps to drive the reaction of the first step in a forward direction and produce more elemental titanium.

The inventor has also discovered that even if the quantity of gaseous aluminium chlorides present in the atmosphere surrounding the heated reaction mixture is reduced, even to a very small amount, species present in the reaction mixture can still react (at least to some extent) to form titanium aluminides. However, the inventor's experiments have indicated that if the concentration of the gaseous aluminium chlorides in the atmosphere surrounding the reaction mixture has been reduced, such reactions are not favourable above a certain temperature. Hence, in some embodiments, the reaction kinetics may also be controlled such that the formation of titanium aluminides via reactions not involving aluminium chlorides is minimised. The formation of titanium aluminides via reactions not involving aluminium chlorides may, for example, be minimised by rapidly heating the reaction mixture comprising elemental titanium to a temperature above which the formation of titanium aluminides is no longer favourable. By doing so, the equilibrium is shifted towards inhibiting formation of titanium aluminides and towards the formation of a product comprising only a small proportion of Al.

In one embodiment, the method of the present invention comprises the steps of:

(a) heating a precursor mixture comprising titanium subchlorides (in an amount at or in excess of the stoichiometric amount required to produce the titanium-aluminium alloy) with aluminium (e.g. aluminium powder or aluminium flakes) to a first temperature and for a time sufficient to enable titanium subchlorides to be reduced by aluminium to form a reaction mixture comprising elemental titanium;

(b) rapidly heating the reaction mixture comprising elemental titanium to a second temperature above which the formation of titanium aluminides is no longer favourable; and (c) exposing the heated reaction mixture to conditions to produce the titanium-aluminium alloy.

One or more gasses in the atmosphere surrounding the heated reaction mixture cause any gaseous aluminium chlorides formed during the method to be diluted. As a result of this dilution, the partial pressure of the aluminium chlorides in the atmosphere in the reaction zone is reduced.

In some embodiments, the gaseous aluminium chlorides formed during the method become entrained in and diluted by a flow of an inert gas (e.g. He or Ar).

In some embodiments, the gaseous aluminium chlorides formed during the method are diluted by gaseous titanium chlorides also formed during the method (the titanium chlorides can evaporate from the reaction mixture at a relatively high temperature).

Typically, any gaseous titanium chlorides formed during the method are caused to be condensed and returned to the reaction mixture. The gaseous titanium chlorides may, for example, be entrained in an inert gas flowing through the apparatus in which the method is being carried out, and condensed as they pass through a portion of the reaction mixture in the apparatus which is at a temperature below the condensation temperature of the titanium chlorides. Once condensed, they can mix with a fresh stream of intermediate materials moving through the apparatus. The inventor has found that this "recycling" of titanium chlorides can enable the resultant titanium-aluminium alloy to have an even lower concentration of aluminium.

As those skilled in the art will appreciate, the first temperature will depend on the composition of the precursor mixture. However, in some embodiments, the first temperature may be in the range of about 400° C. to about 600° C., for example about 500° C., and the precursor mixture may be exposed to this temperature for a period of from about 1 second to about 3 hours (e.g. from about 1 minute to about 30 minutes).

Again, whilst it will depend on the composition of the precursor and reaction mixtures, in some embodiments, the second temperature may be in the range of about 750° C. to about 900° C., for example about 800° C. or about 850° C.

In some embodiments, the reaction mixture comprising elemental titanium is heated to the second temperature over a period of from about 1 second to about 10 minutes (e.g. 10 seconds to about 1 minute).

Typically, step (c) involves heating the reaction mixture from the second temperature to a final temperature and for a time sufficient to produce the titanium-aluminium alloy. The final temperature may, for example, be from about 900° C. to about 1100° C. (e.g. about 1000° C.), or may be even higher in some embodiments. The time taken to heat the reaction mixture from the second temperature to the final temperature may be from about 10 seconds to about 5 hours (e.g. from about 1 hour to about 3 hours). In some embodiments, the reaction mixture may also be heated at the final temperature for a period of time (e.g. about 1 to 2 hours).

In some embodiments, the titanium subchlorides (e.g. the titanium subchlorides in the precursor mixture described above) are formed by reducing titanium tetrachloride with aluminium. Advantageously, in such embodiments, other reductants (e.g. sodium or magnesium) will not subsequently have to be removed from the reaction mixture, lest they contaminate the final product.

In such embodiments, the titanium tetrachloride may be reduced by heating it with aluminium to a temperature of less than about 200° C. (e.g. less than about 136° C., which is the boiling point of $TiCl_4$) for a time sufficient to form the titanium subchlorides. By controlling the reaction kinetics of this reaction in this manner, it is possible to control the reduction of titanium tetrachloride (which is a highly exothermic reaction that can relatively easily become uncontrolled and result in the formation of lumps of aluminium powder and/or products containing multiple phases of titanium aluminides which are often of low quality) such that a reproducible mixture of products can be obtained.

In some embodiments, the titanium tetrachloride can be reduced by aluminium in the presence of $AlCl_3$, which has been found by the inventor to improve the efficiency of the reaction.

In some embodiments, excess aluminium is provided when reducing the titanium tetrachloride. The unreacted aluminium can then be used to reduce the titanium subchlorides via the method of the present invention (e.g. the unreacted aluminium from the reduction of $TiCl_4$ is the aluminium in the precursor mixture used to reduce the titanium subchlorides). Alternatively, in some embodiments, aluminium may be added to the titanium subchlorides to form the precursor mixture.

In some embodiments, it may be desirable to produce a low-aluminium titanium-aluminium alloy incorporating another element or elements. In such embodiments, a source of another element or elements for incorporation into the alloy is also provided in the first step (e.g. in the precursor mixture).

In some embodiments, the reaction kinetics may also be controlled by maintaining the pressure in the reaction zone at or below 2 atmospheres.

In a second aspect, the present invention provides a titanium-aluminium alloy containing less than about 15 wt. % aluminium, produced by the method of the first aspect.

In a third aspect, the present invention provides a method for producing a titanium-aluminium alloy containing less than about 15 wt. % aluminium. The method comprises using aluminium to controllably reduce titanium subchlorides to elemental titanium (i.e. to produce a mixture comprising elemental titanium), and heating the resultant mixture (whilst substantially preventing the elemental titanium from reacting with aluminium chlorides) to a temperature at which, in the substantial absence of aluminium chlorides, the elemental titanium will react with leftover aluminium to form the titanium-aluminium alloy containing less than about 15 wt. % aluminium alloy, and not react to form titanium aluminides.

In a fourth aspect, the present invention provides a method for producing a titanium-aluminium alloy containing less than about 15 wt. % aluminium. The method comprises the stepwise reduction of a titanium tetrahalide with aluminium to form elemental titanium, followed by heating to form the titanium-aluminium alloy, whereby the reaction kinetics are controlled such that reactions between any aluminium halide formed during the method and the elemental titanium are minimised.

BRIEF DESCRIPTION OF THE DRAWINGS

Embodiments of the present invention will now be described by way of example only, with reference to the accompanying drawings in which.

DETAILED DESCRIPTION OF THE INVENTION

Figure 1:
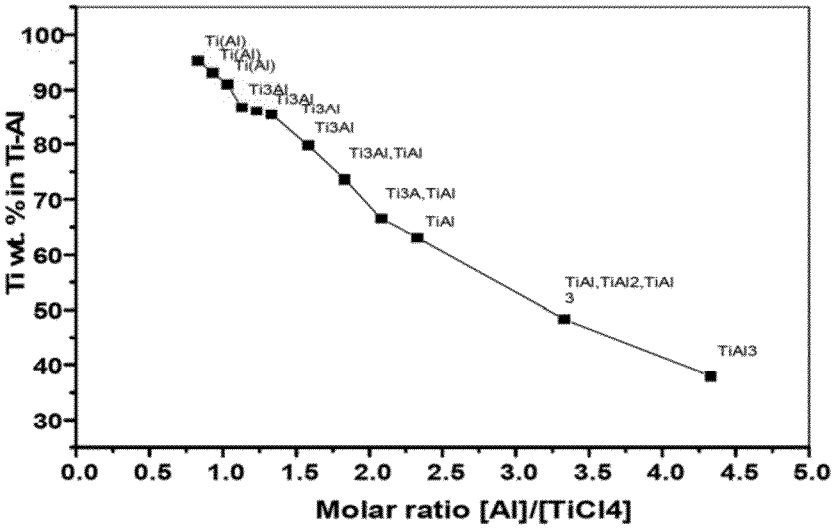
Figure 1 (Prior Art)
FIG. 1 shows a graph illustrating the Ti concentration (wt. %) of various Ti—Al alloys as a function of the [Al]/[$TiCl_4$] ratio in the starting material when the method disclosed in WO 2007/109847 was carried out in batch mode.

As discussed above, the present invention provides a method for producing a titanium-aluminium alloy containing less than about 10 to 15 wt. % (e.g. from about 0.1 to about 7 wt. %) aluminium.

The method of the present invention involves the stepwise reduction of titanium subchlorides with aluminium to form elemental titanium, followed by heating to form the titanium-aluminium alloy. The reaction kinetics are controlled such that reactions resulting in the formation of titanium aluminides are minimised. As the titanium aluminides are mostly formed via reactions between gaseous aluminium chlorides and elemental titanium, the reaction kinetics are typically controlled to minimise these reactions. Typically, the reaction kinetics are also controlled such that the formation of titanium aluminides via other reaction pathways (i.e. via reactions not involving gaseous aluminium chlorides) are also minimised.

Whilst numerous techniques may be used to control the kinetics of a reaction, the simplest techniques involve controlling the temperature and/or pressure to which the reactants are exposed, the time they are exposed to such conditions, as well as the relative concentrations of the reactants and/or products. As those skilled in the art will appreciate, some reactions will not occur until a certain temperature has been reached, whilst some reactions will be less favourable than others at lower temperatures. Some reactions may also occur very slowly at a low temperature, but very quickly once a certain temperature has been reached and vice versa. Further, controlling the relative concentration of the reactants/products can influence the kinetics of the reaction (e.g. controlling the contact surface area between reactants and/or controlling the dominant reactant).

The present invention utilises the unexpected discovery that when reacting titanium subchlorides with aluminium under the conditions required to produce low aluminium alloys, it is actually reactions between elemental titanium and aluminium chlorides which result in the formation of most of the titanium aluminides. The inventor subsequently discovered that by strictly controlling the reaction kinetics such that conditions of non-equilibrium prevail, it is possible to minimise formation of titanium aluminides, and instead form low-aluminium titanium-aluminium alloys.

The amount of titanium subchlorides present in the first step of the method of the present invention must be at or in excess of the stoichiometric amount required to produce the titanium-aluminium alloy. If the amount of titanium subchlorides is below the stoichiometric amount required to produce the titanium-aluminium alloy, then the proportion of aluminium would be too high for the required low aluminium titanium-aluminium alloy to be produced.

Embodiments of the method of the present invention in which the reaction kinetics are controlled by controlling the temperature (and optionally pressure) to which the reactants are exposed during each reaction step, as well as the residence time and relative concentrations of the reactants during these steps, will be described in further detail below.

In these embodiments, the method comprises the steps of:

(a) heating a precursor mixture comprising titanium subchlorides (in an amount at or in excess of the stoichiometric amount required to produce the titanium-aluminium alloy) and aluminium (e.g. aluminium powder or aluminium flakes) to a first temperature and for a time sufficient to enable titanium subchlorides to be reduced by aluminium to form a reaction mixture including elemental titanium;

(b) rapidly heating the reaction mixture including elemental titanium to a second temperature above which the formation of titanium aluminides is no longer favourable; and (c) exposing the heated reaction mixture to conditions to produce the titanium-aluminium alloy.

One or more gasses in the atmosphere surrounding the heated reaction mixture cause any gaseous aluminium chlorides formed during the method to be diluted. As a result of this dilution, the partial pressure of the aluminium chlorides in the atmosphere surrounding the heated reaction mixture is preferably reduced by more than 2×, more preferably by more than 10× and still more preferably by more than 100×, relative to the partial pressure of the gaseous aluminium chlorides if the one or more gasses were not provided.

One or more of these gasses may be externally supplied to the atmosphere surrounding the heated reaction mixture, as is the case when an inert gas is caused to flow through the apparatus containing the heated reaction mixture. Alternatively (or in addition), one or more of the gasses may be produced from the reaction mixture itself, as is the case when titanium chlorides in the reaction mixture are caused to sublime by heating the reaction mixture.

Each of these steps will now be described in turn.

Step (a)

In step (a), a precursor mixture comprising titanium subchlorides is heated with aluminium to a first temperature and for a time sufficient to enable titanium subchlorides to be reduced by the aluminium to form a reaction mixture including elemental titanium.

The titanium subchlorides in the precursor mixture may be provided by reducing titanium tetrachloride with aluminium in a preliminary reaction to form titanium subchlorides, as will be described in more detail below. Advantageously, if aluminium is used as the reductant in this step, purification steps are not required because aluminium will not contaminate the final product. Further, excess aluminium can be used to reduce the titanium tetrachloride to the titanium subchlorides, with the leftover aluminium providing the aluminium in the precursor mixture, and it may not be necessary to add any more aluminium to the precursor mixture before performing step (a).

It is to be appreciated, however, that any method by which titanium tetrachloride can be reduced to form titanium subchlorides (e.g. using hydrogen, sodium or magnesium as the reductant) could be used to provide the titanium subchlorides, in the precursor mixture.

The aluminium content of the resulting titanium-aluminium alloy is determined from the amount of aluminium in the precursor mixture. Accordingly, in order to provide a low-aluminium titanium-aluminium alloy, the titanium subchlorides are provided in the precursor mixture in an amount at or in excess of the stoichiometric amount required to produce the titanium-aluminium alloy.

FIG. 1 shows the titanium content in the resultant alloy (produced using the method disclosed in WO 2007/109847) as a function of the molar ratio of [Al]/[$TiCl_4$] in the starting materials. As can be seen, the aluminium content in the resultant alloy (the Al content is equal to 100 minus the Ti content) can be varied from a few percent, such as for low-aluminium Ti—Al alloys, through to titanium aluminides such as γ-TiAl (i.e. $TiAl_3$) which contain about 60% Al.

These results indicate that titanium-aluminium alloys with an Al content less than about 10 to 15 wt % will therefore be produced only if the titanium subchlorides are provided in the precursor mixture in an amount at or in excess of the stoichiometric amount required to produce the alloy (i.e. the Al content in the starting materials must be below the normal stoichiometric amount required for the reactions between the titanium subchlorides and aluminium).

The proportion of aluminium in the resultant titanium-aluminium alloy may be further reduced by "recycling" the gaseous titanium chlorides which can evaporate from the reaction mixture at relatively high temperatures. During this recycling, as the reaction mixture is heated (e.g. as it progress towards the high temperature zone of the reactor disclosed in WO 2007/109847), the titanium chlorides remaining in the reaction mixture sublime and can be blown (typically by being carried with an inert gas stream) towards a portion of the reaction zone at a lower temperature, where they can re-condense and mix with a fresh stream of materials. As a result of this "recycling" of titanium subchlorides, the [Al]/[$TiCl_x$] ratio for materials entering the high temperature zone further decreases. FIG. 1 suggests that this decrease in [Al]/[$TiCl_x$] will result in a lower concentration of aluminium in the resultant titanium-aluminium alloy.

The aluminium in the precursor mixture (and/or in the preliminary reaction involving $TiCl_4$ described above, in embodiments of the invention which involve such a preliminary reaction) may be provided in any form, for example in the form of a powder or flakes. If the aluminium is provided in a fine powder form, the particles usually have an approximate grain size of less than 50 micrometers in diameter. However, such particles can be quite expensive to produce and would increase the cost of the process. Therefore it is preferable for coarser aluminium powder to be used, where the powder has an approximate grain top size of greater than 50 micrometers in diameter. In such examples, the powder can be mechanically milled to reduce the dimensions of the aluminium powder in at least one dimension. This can result in the production of "flakes" of aluminium which have a size in at least one dimension which is less than 50 micrometers and which is sufficient to facilitate a satisfactory reaction between the titanium subchlorides (or titanium tetrachloride) and the aluminium. Indeed, aluminium flakes provide a higher reaction surface area, and the small thickness of the flakes can result in a more uniform composition of product.

As those skilled in the art will appreciate, the first temperature will depend on the composition of the precursor mixture (which will vary, for example, depending on the composition of the desired low-aluminium titanium-aluminium alloy, and whether other alloying additives are present in addition to the titanium and aluminium). In some embodiments (e.g. where just titanium and aluminium species are present in the reaction mixture), the first temperature may be in the range of about 400° C. to about 600° C. (e.g. about 500° C.), and the precursor mixture may be exposed to this temperature for a period of from about 1 second to about 3 hours (e.g. about 1 minute to about 30 minutes or about 10 minutes to about 2 hours). In alternate embodiments, the first temperature may be about 525° C.

In embodiments where alloying additives are present, the first temperature can be in the range from about 300° C. to about 500° C., as the alloying additives may facilitate reactions between titanium chlorides and aluminium. However, in other embodiments, the alloying additives may act to delay the reactions between titanium chlorides and aluminium and then the first temperature can be in the range from about 550° C. to about 650° C.

It is within the skill of those skilled in the art to determine the first temperature for precursor mixtures that contain a source of another element to be incorporated into the resultant low-aluminium titanium-aluminium alloy.

As the first temperature is reached, the inventor has found that reactions in which titanium subchlorides are reduced by aluminium to form elemental titanium and aluminium chlorides become favourable, and thus occur to a significant extent. As discussed above, the inventor has discovered that, contrary to conventional belief, when reducing titanium subchlorides with aluminium under the conditions required to produce low-aluminium alloys, it is the reactions between elemental titanium and aluminium chlorides which lead to the formation of most of the titanium aluminides. Accordingly, as soon as elemental titanium is present in the reaction mixture to a significant extent, the inventor has found that the reaction kinetics must be carefully control in order to minimise reactions between the elemental titanium and aluminium chlorides.

In this embodiment, the reaction kinetics are controlled by diluting any gaseous aluminium chlorides present in the atmosphere surrounding the heated reaction mixture (step (c)) with one or more gasses. As such, there is less likelihood of reactions between the gaseous aluminium chlorides and the elemental titanium being able to occur. In spite of this, the inventor has found that formation of titanium aluminides can still occur at certain temperatures due to a variety of reasons which the inventor believes may include reactions between gaseous aluminium and titanium, and other reactions not involving gaseous aluminium chlorides. To minimise this formation of titanium aluminides, the reaction kinetics are also controlled by rapidly heating the reaction mixture such that reactions not involving gaseous aluminium chlorides to form titanium aluminides are no longer favourable (step (b)). This will be discussed in further detail below.

Diluting the gaseous aluminium chlorides formed in the atmosphere surrounding the heated reaction mixture with one or more gasses reduces the partial pressure of the gaseous aluminium chlorides in the atmosphere, which decreases the likelihood of them being able to react with elemental titanium. The gas may, for example, be a gas that is caused to flow through the apparatus in which the method is being carried out, thus the gaseous aluminium chlorides are quickly removed from the reaction zone as they are formed, and the likelihood of them reacting with elemental titanium is significantly further reduced.

In some embodiments, the partial pressure of the aluminium chlorides in the atmosphere surrounding the heated reaction mixture may be reduced (even further if a flow of an inert gas is also provided) by causing gaseous titanium chlorides to sublime from the reaction mixture.

Step (b)

In step (b), the reaction mixture comprising elemental titanium is rapidly heated to a second temperature, above which the formation of titanium aluminides is no longer favourable.

Figure 2:
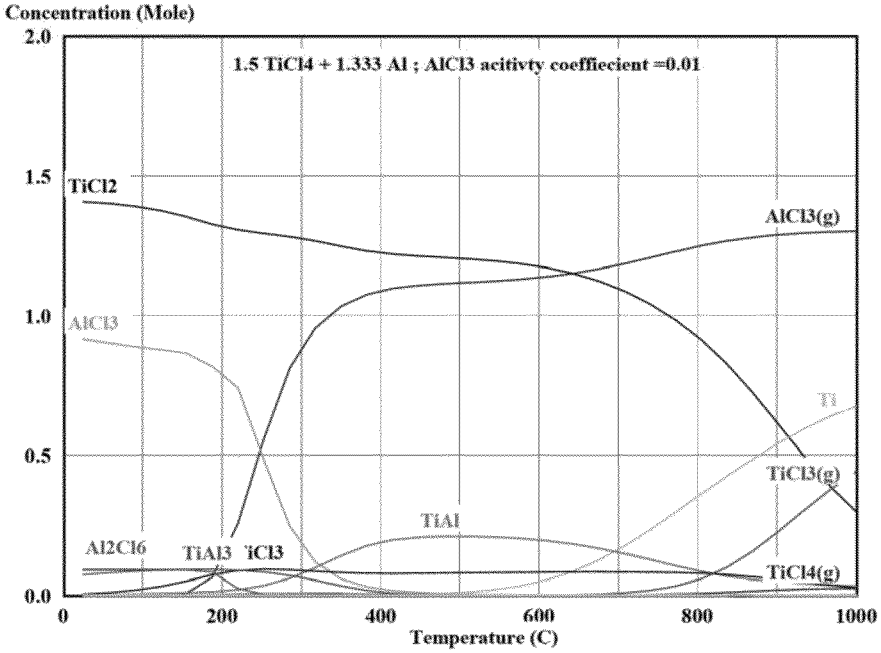
FIG. 2 shows the results of a numerical simulation of the equilibrium composition of a mixture of $TiCl_4$—Al, at a ratio of 1.5:1.333 moles at temperatures of from 0° C. up to 1000° C.

As discussed above, the inventor has discovered that, in the substantial absence of aluminium chlorides, reactions between species remaining in the reaction mixture to form titanium aluminides are not favourable above a certain temperature. In this respect, FIG. 2 shows the results of numerical simulations of the equilibrium conditions for a mixture of $TiCl_4$ and Al (at a ratio of 1.5 to 1.333 moles) at temperatures of from 0° C. to 1000° C. In this numerical simulation, the activity coefficient of $AlCl_3$(g) was reduced to 0.01 to reflect the reduced vapour density of the $AlCl_3$(g) in the atmosphere.

Three regions can be identified in FIG. 2. In the first region, at a temperature of less than about 300° C., the predominant metallic species is $TiAl_3$. In the second region, between the temperatures of about 300° C. and 800° C., the predominant metallic species is TiAl. Accordingly, if reactions were allowed to occur between the species present in the reaction mixture below about 800° C. (with the specific conditions of the depicted numerical simulation), these reactions would result in the formation of predominantly titanium aluminides.

However, in the third region, at a temperature of above about 800° C. to 850° C., elemental titanium is the predominant metallic species. Thus, in order to reduce (or even avoid) the formation of titanium aluminides once elemental titanium has been formed (with the specific conditions of the depicted numerical simulation), it is necessary to rapidly heat the reaction mixture to a temperature where the formation of titanium aluminides is no longer favourable (i.e. above 800° C. under the specific conditions simulated in FIG. 2). Rapidly heating the reaction mixture to the second temperature reduces the time during which reactions leading to titanium aluminides can occur. Once above this second temperature, and in the substantial absence of aluminium chlorides, conditions of non-equilibrium prevail, and there will no longer be significant formation of titanium aluminides. As can be seen in FIG. 2, at 1000° C., a small amount of TiAl is present. This would dissolve into the main Ti matrix, resulting in a solid solution of Ti—Al with a low Al content. Once cooled, this material would become the low-aluminium titanium-aluminium alloy.

Again, it will be appreciated by those skilled in the art that the temperature above which the formation of titanium aluminides is no longer favourable will vary depending on the nature of the materials present in the reaction mixture, the composition of the desired alloy, and other factors that are either known or readily ascertainable by the skilled person. For example, in some embodiments, the second temperature may be between about 700° C. and about 900° C., between about 750° C. and about 850° C. or between about 800° C. and about 850° C. In some embodiments, the second temperature may be about 750° C., about 800° C. or about 850° C. This temperature can be readily ascertained by those skilled in the art for a particular system using routine techniques.

Step (c)

In step (c), the reaction mixture of step (b) is exposed to conditions to produce the titanium-aluminium alloy. Typically, step (c) involves heating the reaction mixture to a final temperature and for a time sufficient to produce the titanium-aluminium alloy. As noted above, during this time, the small amount of TiAl would dissolve into the main Ti matrix, resulting in a solid solution of Ti—Al with a low Al content. The final temperature may, for example, be about 1000° C., or even higher in some embodiments.

When heating the reaction mixture in step (c), titanium chlorides present in the reaction mixture can sublime or evaporate and form gaseous species. In some embodiments, the gaseous titanium chlorides may be entrained in a gas flowing through the reaction zone such that they are carried to a cooler section of the apparatus in which the method is being carried out, where they can recondense and mix with the reaction mixture in that section of the apparatus. In this manner, titanium is effectively recycled, which assists in further lowering the content of aluminium in the reaction mixture (and hence in the resultant alloy). As discussed above, the gaseous titanium chlorides also further dilute the gaseous aluminium chlorides formed, which further reduces the likelihood of reactions occurring between aluminium chlorides and elemental titanium.

The reaction kinetics during the method of the present invention may also be controlled by maintaining the pressure in the reaction zone at or below 2 atmospheres, typically at about 1 atmosphere. The inventor has found that increasing the pressure under which the method of the present invention is carried out causes the density of the gaseous aluminium chlorides to increase, which increases the likelihood of undesirable reactions between the aluminium chlorides and elemental titanium.

Preliminary Reactions to Form the Titanium Subchlorides

Although not necessarily forming part of the method of the present invention in its broadest form, it is useful to briefly describe how a mixture comprising titanium subchlorides and aluminium may be formed for use in the methods of present invention (e.g. the precursor mixture for use in step (a) as described above). This reaction is essentially the same as that disclosed in WO 2007/109847.

In a preliminary reaction, aluminium is introduced together with an appropriate quantity of $TiCl_4$ into a vessel. In some embodiments, the aluminium may also be thoroughly mixed with anhydrous $AlCl_3$ just prior to being added to the $TiCl_4$. The inventor has found that using $AlCl_3$ can improve the efficiency of the reaction, especially at lower temperatures.

The mixture of $TiCl_4$ and Al, optionally with $AlCl_3$ is heated so as to obtain an intermediate solid powder of $TiCl_x$—Al—$AlCl_3$. In some embodiments, the heating temperature can be below 200° C., for example, below 150° C. $AlCl_3$ has a sublimation point of around 160° C. and, as it is desirable to maintain aluminium chloride in solution, in some embodiments, the reactions are performed at about 160° C. In some embodiments, the heating temperature can even be below 136° C. (i.e. below the boiling point of $TiCl_4$) so that the solid-liquid reactions between $TiCl_4$ and Al are predominant.

The mixture of $TiCl_4$—Al—$AlCl_3$ can be stirred in a preliminary reaction zone whilst being heated so as the resulting products of $TiCl_3$—Al—$AlCl_3$ are powdery and uniform. By adding an amount of aluminium in excess of the stoichiometric amount required to reduce $TiCl_4$ to $TiCl_3$ or $TiCl_2$ ("$TiCl_{2,3}$"), all of the $TiCl_4$ can be reduced to form the resulting products of $TiCl_{2,3}$—Al—$AlCl_3$ and it may not be necessary to add any further aluminium to produce the precursor mixture for step (1) of the present invention. Alternatively, additional Al may be added to the products of the preliminary reaction.

In some embodiments, the $TiCl_4$ and/or the solid reactants of Al and optionally $AlCl_3$ are fed gradually into the reaction vessel. In all embodiments, sources of additional elements can be added to the starting $TiCl_4$—Al—$AlCl_3$ mixture. At the end of this reduction step, any un-reacted $TiCl_4$ may be separately collected from the resulting solid precursor material of $TiCl_{2,3}$—Al—$AlCl_3$ for recycling before step (1) of the method of the present invention is carried out.

Other Alloying Additives

It is also possible to include a source of another element or elements (i.e. an element or elements in addition to titanium and aluminium) in the methods of the present invention in order to obtain low-aluminium titanium-aluminium alloys which incorporate the other element(s). In some embodiments, the source(s) of the additional element(s) may be mixed with the titanium subchlorides before they are reduced with the aluminium. Alternatively, the source(s) of the additional element(s) may be introduced at a different processing stage.

For example, in some embodiments, the source(s) of the additional element(s) can be milled with aluminium and added to either the precursor mixture described above or to the aluminium used to reduce the titanium tetrachloride, in embodiments of the invention which include this preliminary step. In some embodiments, the sources(s) of the additional element(s) can even be added to the reaction mixture after the reactions to form the low-aluminium titanium-aluminium alloys have commenced.

In embodiments where it is desired to form low-aluminium titanium-aluminium alloys containing vanadium, for example, vanadium chloride ($VCl_4$) and/or vanadium subchlorides (such as vanadium trichloride ($VCl_3$) and/or vanadium dichloride ($VCl_2$)) may be added (e.g. to the precursor mixture), and the resultant alloy would include vanadium. For example, the alloy Ti-6Al-4V (i.e. a titanium alloy with 6 wt % aluminium and 4 wt % vanadium, which has improved metal properties such as better creep resistance, fatigue strength, and the ability to withstand higher operating temperatures) can be prepared in this manner.

The source of another element may, for example, be a metal halide, a metal subhalide, a pure element or another compound which includes the element (preferably metal halides and more preferably metal chlorides). The source may also include a source of other precursors containing a required alloy additive, depending upon the required end product. The source of the additional element can be in a solid, liquid or a gaseous form. When the source of the additional element is a halide based chemical having properties similar to titanium chlorides, the recycling process described above for titanium subchlorides within the reaction zone may also occur for the source of the additional elements. For example, for production of Ti-6Al-4V, where vanadium trichloride is the source of vanadium, $VCl_3$ and $VCl_2$ may behave similar to $TiCl_3$ and $TiCl_2$, and recycling occurring within the reaction zone may include both titanium subchlorides and vanadium subchlorides.

Alloys which can be produced using the method of the present invention may include titanium, aluminium and any other additional element or elements which one skilled in art would understand could be incorporated into the alloy, such as metallic or non-metallic elements, for example. Typical elements include chromium, vanadium, niobium, molybdenum, zirconium, silicon, boron, tantalum, carbon, tin, hafnium, yttrium, iron, copper, nickel, oxygen, nitrogen, lithium, bismuth, manganese or lanthanum. Other elements include beryllium, sulphur, potassium, cobalt, zinc, ruthenium, rhodium, silver, cadmium, tungsten, platinum or gold.

As will be appreciated by those skilled in the art, the elements listed above are examples of suitable elements, and many other elements could be included in the method of the present invention.

For example, the titanium-aluminium based alloy may be based on the system of a Ti—Al—V alloy, a Ti—Al—Nb—C alloy, a Ti—Al—Fe alloy or a Ti—Al—$X_n$ alloy (wherein n is the number of the additional elements X and is less than 20, and X is an additional, element such as chromium, vanadium, niobium, molybdenum, zirconium, silicon, boron, tantalum, carbon, tin, hafnium, yttrium, iron, copper, nickel, oxygen, nitrogen, lithium, bismuth, manganese and lanthanum.

Specific examples of low-aluminium titanium-aluminium alloys which can be produced using the method of the present invention are: Ti-6Al-4V, Ti-10V-2Fe-3Al, Ti-13V-11Cr-3Al, Ti-2.25-Al-11Sn-5Zr-1Mo-0.2Si, Ti-3Al-2.5V, Ti-3Al-8V-6Cr-4Mo-4Zr, Ti-5AI-2Sn-2Zr-4Mo-4Cr, Ti-5Al-2.5Sn, Ti-5Al-5Sn-2Zr-2Mo-0.25Si, Ti-6Al-2Nb-1Ta-1Mo, Ti-6Al-2Sn-2Zr-2Mo-2Cr-0.25Si, Ti-6Al-2Sn-4Zr-2Mo, Ti-6Al-2Sn-4Zr-6Mo, Ti-6Al-2Sn-1.5Zr-1Mo-0.35Bi-0.1Si, Ti-6Al-6V-2Sn-0.75Cu, Ti-7AI-4Mo, Ti-8Al-1Mo-1V, or Ti-8Mo-8V-2Fe-3Al.

The low-aluminium titanium-aluminium alloys produced using the method of the present invention may, for example, be in the form of a fine powder, an agglomerated powder, a partially sintered powder or a sponge like material.

The product may be further processed (e.g. to produce other materials). Alternatively a powder may be heated to make a coarser grain powder, or compacted and/or heated and then melted to produce ingot. Preferably, the low-aluminium titanium-aluminium alloys are produced in powder form, which is more versatile for the manufacture of titanium-aluminium alloy products, e.g. shaped fan blades that may be used in the aerospace industry.

The amount of aluminium in the low-aluminium titanium-aluminium alloy which can be produced using the method of the present invention is less than about 15 wt. %, and may, for example, be between 0.1% and 15 wt. % of the alloy. In some embodiments, the alloy may comprise between 0.1 and 10 wt % Al, between 0.1 and 9 wt % Al, between 0.5 and 9 wt % Al, or between 1 and 8 wt % Al. In some embodiments, the alloy may comprise 0.5 wt %, 1 wt %, 2 wt %, 3 wt %, 4 wt %, 5 wt % 5 wt %, 6 wt %, 7 wt %, 8 wt % or 10 wt % Al.

Reaction Vessel

The method of the present invention can be carried out in any suitable reaction vessel that has been adapted to provide the necessary control over the reaction kinetics (e.g. temperature and pressure conditions). For example, the reactors disclosed in WO 2007/109847 and WO 2009/129570 could be adapted to perform the method of the present invention. Specific illustrative embodiments will be described in detail below.

In a reaction vessel containing titanium subchlorides and aluminium (and optionally other alloying additives), a reaction zone is heated to a first temperature (e.g. 500° C. or 525° C.) at which significant reaction between the titanium subchlorides (in particular titanium trichloride) and aluminium occurs. After a sufficient time, some of the titanium subchlorides will have been reduced by the aluminium to produce a powder of elemental titanium in the reaction zone (which also contains a certain percentage of aluminium, as required for the end product) and gaseous aluminium chlorides. The gaseous aluminium chlorides are diluted by a gas (typically an inert gas such as Ar and titanium chlorides which, as discussed below, have sublimed from the reaction mixture at a higher temperature zone), which may be caused to flow through the reaction zone, as will be described below.

As discussed above, the inventor has discovered that, contrary to conventional belief, when reacting titanium subchlorides with aluminium to produce low-aluminium alloys, it is reactions between elemental titanium and aluminium chlorides which mostly result in the formation of titanium aluminides (which prevents the formation of low-aluminium titanium-aluminium alloys). Thus, once reactions to produce elemental titanium are occurring to a significant extent, diluting the gaseous aluminium chlorides in the atmosphere surrounding the reaction mixture greatly reduces the formation of titanium aluminides.

However, even though the partial pressure of the gaseous aluminium chlorides is being reduced in the atmosphere surrounding the reaction zone, it is typically also necessary for the reaction mixture to be rapidly heated to a temperature at which the formation of titanium aluminides is no longer kinetically favourable because other species present in the reaction mixture can also react to form titanium aluminides. This might be the case, for example, if an alloy having a very low content of aluminium is desired. The reaction mixture is therefore rapidly heated to a second temperature, either in the same reaction zone or a different reaction zone. In some embodiments, this may be achieved by rapidly moving the reaction mixture from one section of the vessel to another (e.g. using a rake apparatus). In other embodiments, this may be achieved by rapidly heating the reaction zone itself.

The reaction mixture is then heated from the second temperature to a temperature at which reactions to form the low-aluminium titanium-aluminium alloy occur. The second temperature will depend on the nature of the materials in the reaction mixture and the desired titanium-aluminium alloy, but will typically be above 800° C. (e.g. 850° C.), which, as discussed above, is the temperature at which the inventor's experiments have indicated that reactions to form titanium aluminides become less kinetically favourable.

The reactions which occur above the second temperature are mostly based on solid-solid reactions between titanium subchlorides and aluminium compounds. However, at temperatures above the second temperature, titanium chlorides can decompose and sublime, resulting in the presence of gaseous species of $TiCl_4(g)$, $TiCl_3(g)$ and $TiCl_2(g)$ in the reaction zone. Gas-solid reactions may occur between these species and aluminium-based compounds in the reaction mixture. The reactions in the second section are usually carried out at temperatures of up to about 1000° C. (or even higher, depending on the nature of the alloy being produced) in order to produce consistent products. Gaseous titanium chlorides also help dilute the aluminium chlorides and significantly reduce reactions between elemental titanium and aluminium chlorides.

A gas may be caused to flow through the vessel in order to dilute and preferably remove the gaseous aluminium chlorides in the atmosphere in the reactor, as well as preferably causing the recycling of the titanium chlorides discussed above. As the materials in the reactor are often pyrophoric and dangerous to handle, the reactor will typically comprise a source of an inert gas (e.g. helium or argon) and be adapted to cause the inert gas to flow through the reaction zone in a reverse direction to the reaction mixture, until it eventually exits the reaction zone via a gas outlet.

Typically, the flow of gas will be driven by a blower that blows the gas through the reactor. However, it will be appreciated that other mechanisms for causing the gas to be driven through the reactor (e.g. mild pressure, sucking or convection) could be utilised.

The residence time of reaction mixture in the respective sections of the reactor can be determined by factors known to those skilled in the art, and will depend on the composition and properties of the reactants and desired end products. For example, for powdered products having low Al content, such as Ti-6Al, an excess of titanium subchlorides will need to be removed from the reaction mixture prior to proceeding towards the outlet of the reactor. As a result, more heat is required and the material needs to remain longer at 1000° C. to minimise the chlorine content in the resultant alloy.

Example

Described below is an example in which the method of the present invention has been used to produce Ti-6 wt % Al-4 wt % V, commonly known as Ti64. This alloy is widely used in the aerospace industry.

Ti-6 wt % Al-4 wt % V is produced using the starting materials liquid $TiCl_4$, $VCl_3$ powder and fine Al powder. The stoichiometric reaction leading to Ti64 is:

$$TiCl_4+1.494Al+0.042VCl_3 \rightarrow Ti\text{-}0.112\text{ at \% }Al\text{-}4.2\text{ at \% }V+AlCl_3$$

Al powder (200 g) and $VCl_3$ (32.6 g) were first mixed with $AlCl_3$ (100 g) and loaded into a vessel under argon. The mixture could be milled if a more uniform distribution of the vanadium is required.

The vessel was then heated to a temperature around 100° C. at 1 atm, and 650 ml of $TiCl_4$ was gradually added to the mixture. The resultant mixture was maintained at a temperature below 137° C. for several hours, after which the materials were dried to remove unreacted $TiCl_4$. The mixture of intermediate products (around 980 g of a violet coloured powder consisting of, $TiCl_3$, Al, $VCl_3$, $AlCl_3$ and $TiCl_2$ (in small quantities)) was discharged out of the vessel.

This mixture was then heated at temperatures from 200° C. to 1000° C. in a second reaction vessel, as described below. Gaseous aluminium chloride by-products were diluted with argon present in the reaction vessel and with gaseous titanium chlorides evaporated from a higher temperature of the reaction zone, and were removed from the reaction vessel using flowing Argon.

The powder of intermediate products was first moved slowly in the vessel from a temperature of about 200° C. to about 500° C., which caused the $TiCl_3$ to react with the Al powder and lead to the formation of a significant amount of elemental titanium. This elemental titanium, together with the other species in the powder (including titanium subchlorides) was then rapidly heated to a temperature of more than 800° C. Following this, the temperature was again gradually increased to about 1000° C. The resultant product was then dropped out of the vessel and into a collection vessel.

As the temperature of the reactants increased above 800° C., there occurred a significant sublimation of titanium chloride species due to the presence of only a small amount of Al reactant, which resulted in a major dilution of the gaseous aluminium chloride by-products formed. As the gaseous titanium chlorides and aluminium chlorides were driven towards the inlet of the reaction vessel (which has a lower temperature), the gaseous titanium chlorides condensed and mixed with fresh reaction material that was moving toward the high temperature region. In this manner, the amount of titanium in the reaction material was caused to increase, making it possible to form the low-aluminium titanium-aluminium alloy.

The product was collected in small samples every few minutes and analysed. Materials collected at the beginning of the run were found to be rich in Al at around 10 wt %. However, as the system operation approached a steady state, the Al concentration decreased, resulting in the production of a titanium-aluminium-vanadium alloy having a composition of around 6 wt % Al and 4 wt % V.

It will be understood to persons skilled in the art of the invention that many modifications may be made without departing from the spirit and scope of the invention. For example, the method of the present invention could control the reaction kinetics of the stepwise reactions to reduce titanium subchlorides in ways other than controlling the temperature of the reactions, e.g. by controlling the pathway of the aluminium chlorides in the reactor to minimise or maximise reactions with elemental titanium depending on desired end product.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed is:

1. A method for producing a titanium-aluminum alloy containing less than about 15 wt. % aluminum, comprising:

a first step in which an amount of titanium subchlorides at or in excess of a stoichiometric amount required to produce the titanium-aluminum alloy are reduced by aluminum to form a reaction mixture comprising elemental titanium, and then a second step in which the reaction mixture comprising elemental titanium is heated to form the titanium-aluminum alloy, whereby reaction kinetics of the method are controlled such that reactions resulting in formation of titanium aluminides are minimized.

2. The method according to claim 1, whereby the reaction kinetics are controlled such that reactions between aluminum chlorides formed during the method and elemental titanium are minimized.

3. The method according to claim 2, whereby reaction kinetics are also controlled such that the formation of titanium aluminides via reactions not involving aluminum chlorides is minimised.

4. The method according to claim 3, whereby the formation of titanium aluminides via reactions not involving aluminum chlorides is minimized by rapidly heating the reaction mixture comprising elemental titanium to a temperature above which formation of titanium aluminides is no longer favourable.

5. The method according to claim 2, wherein, in the first step:

(a) a precursor mixture comprising titanium subchlorides and aluminum is heated to a first temperature and for a time sufficient to enable titanium subchlorides to be reduced by aluminum to form a reaction mixture comprising elemental titanium;

and then, in the second step:

(b) rapidly heating the reaction mixture comprising elemental titanium to a second temperature above which formation of titanium aluminides is no longer favourable; and (c) exposing the heated reaction mixture to conditions to produce the titanium-aluminum alloy;

whereby one or more gasses in an atmosphere surrounding the heated reaction mixture cause any gaseous aluminum chlorides formed during the method to be diluted.

6. The method according, to claim 1, whereby aluminum chlorides are formed during the method, at least some of the aluminum chlorides produced being gaseous, and whereby reaction kinetics are controlled by causing a concentration of gaseous aluminum chlorides formed during the method in an atmosphere surrounding the heated reaction mixture to be reduced.

7. The method according to claim 6, whereby the gaseous aluminum chlorides formed during the method become entrained in and are diluted by a flow of an inert gas.

8. The method according to claim 7, whereby the gaseous aluminum chlorides formed during the method are diluted by gaseous titanium chlorides also formed during the method.

9. The method according to claim 6, whereby the gaseous aluminum chlorides formed during the method are diluted by gaseous titanium chlorides also formed during the method.

10. The method according to claim 1, wherein, in the first step:

(a) a precursor mixture comprising titanium subchlorides and aluminum is heated to a first temperature and for a time sufficient to enable titanium subchlorides to be reduced by aluminum to form a reaction mixture comprising elemental titanium;

and then, in the second step:

(b) rapidly heating the reaction mixture comprising elemental titanium to a second temperature above which the formation of titanium aluminides is no longer favourable; and (c) exposing the heated reaction mixture to conditions to produce the titanium-aluminum alloy;

whereby one or more gasses in an atmosphere surrounding the heated reaction mixture in (b) cause any gaseous aluminum chlorides formed during the method to be diluted.

11. The method according to claim 10, whereby gaseous aluminum chlorides formed during the method become entrained in and diluted by a flow of an inert gas.

12. The method according to claim 11, whereby the gaseous aluminum chlorides formed during the method are diluted by gaseous titanium chlorides also formed during the method.

13. The method according to claim 11, whereby any gaseous titanium chlorides formed during the method are caused to be condensed and returned to the reaction mixture.

14. The method according to claim 10, whereby gaseous aluminum chlorides formed during the method are diluted by gaseous titanium chlorides also formed during the method.

15. The method according to claim 14, whereby any gaseous titanium chlorides formed during the method are caused to be condensed and returned to the reaction mixture.

16. The method according to claim 10, whereby any gaseous titanium chlorides formed during the method are caused to be condensed and returned to the reaction mixture.

17. The method according to claim 16, whereby gaseous titanium chlorides become entrained in a flow of an inert gas, and are condensed as they pass through a portion of the reaction mixture which is at a temperature below a condensation temperature of the titanium chlorides.

18. The method according to claim 10, wherein the first temperature is in the range of about 400° C. to about 600° C. and wherein titanium subchlorides are reduced by aluminum to form a reaction mixture comprising elemental titanium over a period of from about 1 second to about 3 hours.

19. The method according to claim 10, wherein the second temperature is in the range of about 750° C. to about 900° C. and wherein the reaction mixture comprising elemental titanium is heated to the second temperature over a period of from about 1 second to about 10 minutes.

20. The method according to claim 10, wherein step (c) involves heating the reaction mixture from the second temperature to a final temperature and for a time sufficient to produce the titanium-aluminum alloy.

21. The method according to claim 20, wherein the final temperature is in the range of about 900° C. to about 1100° C.

22. The method according, to claim 10, whereby the method also comprises:

a preliminary step of reducing titanium chloride with aluminum to produce the precursor mixture of titanium subchlorides and aluminum; and whereby the method also comprises:

carrying out the first and second steps of the method in a reactor, whereby the reaction mixture is moved through the reactor from a reaction zone of the reactor at the first temperature to a reaction zone of the reactor at the second temperature;

flowing an inert gas through the reactor in a reverse direction to the reaction mixture;

sublimating excess titanium chlorides in the reaction zone at the second temperature and driving the gaseous titanium chlorides towards the reaction zone at the first temperature using the inert gas flow;

diluting any gaseous aluminum chloride produced in the method with the inert gas and any gaseous titanium subchlorides produced during the method and removing the diluted gaseous aluminum chloride from the reactor via a gas outlet; and condensing any gaseous titanium chlorides formed during the method and returning the condensed titanium chlorides to the reaction mixture moving towards the reaction zone at the second temperature.

23. The method according to claim 1, wherein the titanium subchlorides are formed by reducing titanium tetrachloride with aluminum, by heating the titanium tetrachloride and excess aluminum to a temperature of less than about 200° C. for a time sufficient to form the titanium subchlorides and wherein reacted aluminum is then used to reduce the titanium subchlorides.

24. The method according to claim 1, wherein a source of another element or elements for incorporation into the alloy is also provided in the first step, wherein the element or elements are selected from the group consisting of: vanadium, niobium, chromium, molybdenum, zirconium, silicon, boron, tantalum, carbon, tin, hafnium, yttrium, iron, copper, nickel, oxygen, nitrogen, lithium, bismuth, manganese and lanthanum.

25. The method according to claim 1, wherein the aluminum content of the alloy is from about 0.1 to about 7 wt. %.

26. The method according to claim 1, wherein pressure in an atmosphere surrounding the heated reaction mixture is maintained at or below 2 atmospheres.

27. The method according to claim 1, whereby the method also comprises:

a preliminary step of reducing titanium chloride with aluminum to produce a solid mixture of the titanium subchloride and aluminum for the first step of the method; and whereby the method also comprises:

carrying out the first and second steps of the method in a reactor, whereby the reaction mixture is moved through the reactor from a reaction zone of the reactor at a first temperature for carrying out the first step to a reaction zone of the reactor at a second temperature for carrying out the second step;

flowing an inert gas through the reactor in a reverse direction to the reaction mixture;

sublimating excess titanium chlorides in the reaction zone at the second temperature and driving the gaseous titanium chlorides towards the reaction zone at the first temperature using the inert gas flow;

diluting any gaseous aluminum chloride produced in the method with the inert gas and any gaseous titanium subchlorides produced during the method and removing the diluted gaseous aluminum chloride from the reactor via a gas outlet; and condensing any gaseous titanium chlorides formed during, the method and returning the condensed titanium chlorides to the reaction mixture moving towards the reaction zone at the second temperature.

28. The method according to claim 1, wherein the reaction kinetics are controlled by, in the second step, rapidly heating the reaction mixture comprising elemental titanium to a temperature in the range of 750° C.-900° C. above which the formation of titanium aluminides is no longer favourable.

29. The method according to claim 1, wherein the method comprises carrying out the method in a reaction vessel containing a reaction zone, and as the reaction mixture is heated in the method, any titanium chlorides remaining in the reaction mixture sublime and are blown towards a portion of the reaction zone at a lower temperature, where they re-condense and mix with a fresh stream of materials.

30. The method according to claim 1, wherein in the first step, a stoichiometric excess of titanium subchlorides are reacted with the aluminum.

31. The method according to claim 1, whereby the reaction kinetics of the method are controlled such that reactions resulting in formation of titanium aluminides from elemental titanium are minimized.

32. The method according to claim 31, whereby the reaction kinetics of the method are controlled such that reactions resulting in formation of titanium aluminides from titanium subchlorides are minimized.

33. The method according to claim 1, whereby the reaction kinetics of the method are controlled such that reactions resulting in formation of titanium aluminides from titanium subchlorides are minimized.

34. A method for producing a titanium-aluminum alloy containing less than about 15 wt. aluminum, the method comprising controllably reducing titanium subchlorides using aluminum to form a reaction mixture comprising elemental titanium, and heating the mixture, whilst substantially preventing the elemental titanium from reacting with aluminum chlorides, to a temperature at which the elemental titanium will react with leftover aluminum from the reduction of the titanium subchlorides to form the titanium-aluminum alloy containing less than about 15 wt. % aluminum, and not react to form titanium aluminides.

35. A method for producing a titanium-aluminum alloy containing less than about 15 wt. % aluminum, the method comprising stepwise reducing a titanium tetrahalide with aluminum to form elemental titanium, followed by heating to form the titanium-aluminum alloy, whereby reaction kinetics are controlled such that reactions between any aluminum halide formed during the method and the elemental titanium are minimized.

* * * * *